US011649516B2

(12) United States Patent
Li et al.

(10) Patent No.: US 11,649,516 B2
(45) Date of Patent: May 16, 2023

(54) METHOD FOR MANUFACTURING THIN-SPECIFICATION HIGH-TI WEAR-RESISTANT STEEL NM450

(71) Applicant: SOUTH CHINA UNIVERSITY OF TECHNOLOGY, Guangdong (CN)

(72) Inventors: Liejun Li, Guangdong (CN); Feng Zhou, Guangdong (CN); Jixiang Gao, Guangdong (CN); Haibo Sun, Guangdong (CN); Jietao Dai, Guangdong (CN); Zhengwu Peng, Guangdong (CN); Yanjun Lu, Guangdong (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 245 days.

(21) Appl. No.: 16/499,324

(22) PCT Filed: Dec. 11, 2017

(86) PCT No.: PCT/CN2017/115390

§ 371 (c)(1),
(2) Date: Sep. 30, 2019

(87) PCT Pub. No.: WO2018/176908

PCT Pub. Date: Oct. 4, 2018

(65) Prior Publication Data

US 2020/0056254 A1 Feb. 20, 2020

(30) Foreign Application Priority Data

Mar. 31, 2017 (CN) ..... 201710204549.6

(51) Int. Cl.

| | |
|---|---|
| ***C21D 1/18*** | (2006.01) |
| ***C21D 8/02*** | (2006.01) |
| ***C21D 9/573*** | (2006.01) |
| ***C22C 38/02*** | (2006.01) |
| ***C22C 38/04*** | (2006.01) |
| ***C22C 38/12*** | (2006.01) |
| ***C22C 38/14*** | (2006.01) |
| ***C22C 38/26*** | (2006.01) |
| ***C22C 38/32*** | (2006.01) |

(52) U.S. Cl.

CPC ..... *C21D 8/0226* (2013.01); *C21D 1/18* (2013.01); *C21D 8/0236* (2013.01); *C21D 8/0242* (2013.01); *C21D 9/573* (2013.01); *C22C 38/02* (2013.01); *C22C 38/04* (2013.01); *C22C 38/12* (2013.01); *C22C 38/14* (2013.01); *C22C 38/26* (2013.01); *C22C 38/32* (2013.01); *C21B 2400/026* (2018.08); *C21B 2400/03* (2018.08); *C21D 2211/001* (2013.01)

(58) Field of Classification Search

CPC ..... C21B 2400/026; C21B 2400/03; C21D 8/0226; C21D 8/0242; C21D 8/0263; C21D 9/573; C21D 1/18; C21D 1/25; C22C 33/04; C22C 38/32

See application file for complete search history.

(56) References Cited

U.S. PATENT DOCUMENTS

| | | | | |
|---|---|---|---|---|
| 2,110,066 | A * | 3/1938 | Heuer | C21C 1/02 75/467 |
| 4,371,392 | A * | 2/1983 | Hasegawa | C22B 9/103 75/10.34 |
| 6,447,622 | B1 * | 9/2002 | Yamada | C22C 38/04 148/320 |
| 2012/0134872 | A1 | 5/2012 | Moody | |

FOREIGN PATENT DOCUMENTS

| | | | |
|---|---|---|---|
| CN | 101254527 | B * | 12/2010 |
| CN | 101758176 | B * | 3/2012 |
| CN | 103194684 | | 7/2013 |
| CN | 104726668 | A * | 6/2015 |
| CN | 104962834 | | 10/2015 |
| CN | 105063497 | | 11/2015 |
| CN | 104962834 | B * | 1/2017 |
| CN | 107099728 | | 8/2017 |
| CN | 107099730 | | 8/2017 |
| JP | 2014227583 | | 12/2014 |
| JP | 2016160513 | | 9/2016 |

OTHER PUBLICATIONS

Seshadri Seetharaman, Treatise on Process Metallurgy, 2014, Elsevier, vol. 3: Industrial Processes (Year: 2014).*

Junlai Li, Yonghe Xie, Comprehensive Improvement Technology Research on Marine Shot Blasting Machine, 2015. 3rd International Conference on Material, Mechanical and Manufacturing Engineering (Year: 2015).*

Xia Zhang, Translated Patent Description of CN-101758176-B (Year: 2012).*

Da Hu, Translated Patent Description of CN-101254527-B (Year: 2010).*

Bai Xuejun, Translated Patent Description of CN-104962834-B (Year: 2017).*

Li Xueyan, Translated Patent Description of CN-104726668-A (Year: 2015).*

(Continued)

*Primary Examiner* — Anthony M Liang
*Assistant Examiner* — Maxwell Xavier Duffy
(74) *Attorney, Agent, or Firm* — JCIPRNET

(57) ABSTRACT

A method for manufacturing thin-specification high-Ti wear-resistant steel NM450 comprises the steps of preparing melted iron in a blast-furnace, preprocessing the melted iron, smelting the melted iron in a converter, refining the melted steel in a LF furnace, refining the melted steel in a RH furnace, conventional slab continuous casting, heating the slab in a heating furnace, dephosphorizing the slab by high-pressure water, heating the slab in a hot continuous rolling mill, performing ultra fast cooling, reeling, flattening, heating, quenching, tempering and finishing.

6 Claims, No Drawings

(56) References Cited

OTHER PUBLICATIONS

"International Search Report (Form PCT/ISA/210) of PCT/CN2017/115390", dated Mar. 5, 2018, with English translation thereof, pp. 1-6.

Deng Xiangtao, "Microstructure and Mechanical Property Control and Wear Mechanism Sdudy for Low-alloy Abrasion Resistant Steel", A Doctoral Dissertation in Materials Forming Engineering, Northeastern University, Apr. 2014, pp. 1-198.

Deng Xiangtao, "Designing Chemical Composition and Heat Treatment Technology Study on NM450 Grade Ultra-High Strength Low Alloy Plate", A Thesis submitted for the Master Degree of Materials Forming Engineering, Northeastern University, Jul. 2009, pp. 1-76.

Li Jing, "Development of Wear-Resistant Steel Grade NM450 for Engineering Mechinary", A Thesis submitted for the Master Degree of Materials Science, Hebei University of Technology, Jan. 2012, pp. 1-53.

* cited by examiner

METHOD FOR MANUFACTURING THIN-SPECIFICATION HIGH-TI WEAR-RESISTANT STEEL NM450

CROSS-REFERENCE TO RELATED APPLICATION

This application is a 371 application of the international PCT application serial no. PCT/CN2017/115390, filed on Dec. 11, 2017, which claims the priority benefit of China application no. 201710204549.6, filed on Mar. 31, 2017. The entirety of each of the above-mentioned patent applications is hereby incorporated by reference herein and made a part of this specification.

TECHNICAL FIELD

The present invention belongs to the field of wear-resistant steel manufacturing technologies, and more particularly, relates to a method for manufacturing thin-specification high-Ti wear-resistant steel NM450.

BACKGROUND

Wear-resistant and heat-resistant steel pieces are widely applied in working conditions like high-temperature oxidizing atmosphere and abrasive wear, the performances of which directly affect the normal operation of the whole device. Materials are not only required to have a strong high-temperature strength and a certain wear resistance, but also need to have a good oxidation resistance, so as to meet requirements on the service performances thereof. The pieces with a good service performance and a long service life can not only greatly reduce material consumption and production costs, and have good economic benefits, but also ensure safe production, improve equipment operation efficiency, simultaneously reduce equipment maintenance workload, reduce labor intensity, improve workers' working condition, and have good social benefits. The pieces are widely applied in mining machinery, electric power industry, cement industry, coal processing industry and other industries. The annual consumption of low-alloy wear-resistant steel plates is about one million tons in China, and a large amount of wear-resistant cast steel and high manganese steel are also being gradually replaced. At present, a small amount of domestic products are used for specifications of 10 mm and below in China, and hardox series of Swedish SSAB is mainly used which has the defects of high price and long supply cycle. In the past, the wear-resistant steel is mainly microalloyed with precious alloys such as Ni, Cu, Mo, Nb and V. However, with rising prices of Ni, Cu, Mo and Nb, the product costs have remained high. During the tough time of low or even no profits for steel materials in recent years, the price costs of final steel products become the market competitiveness and driving force for the production and development of steel enterprises. However, the research and development of the wear-resistant steel mainly microalloyed with Ti, especially the development of titanium-microalloyed wear-resistant steel with low costs and high performances have been paid much attention. When a continuous casting and rolling line by a traditional slab is used to produce high-Ti-microalloyed thin-specification wear-resistant steel, the production time from melted steel smelting to product delivery can be shortened within 24 hours, with the advantages of low production costs, good thin-specification plate shape, uniform and stable product performance and remarkable market competitiveness.

SUMMARY

The present invention is intended to provide a method for manufacturing thin-specification high-Ti wear-resistant steel NM450, and compared with a traditional wear-resistant steel production technology of hot rolling+off-line quenching+tempering heat treatment, a technology of continuous casting and rolling by using a traditional high-Ti slab is combined with an ultra fast cooling technology in the method to obtain a better and finer micro-structure, which gives full play to the role of Ti microalloying, reduces the use of precious alloys, and produces thin-specification wear-resistant steel with a high wear resistance, a corrosion resistance, a high heat resistance, a good welding performance and a good plate shape, thus reducing production costs, shortening a delivery cycle, and improving a market competitiveness of products.

In order to achieve the object above, the following technical solutions are employed in the present invention.

A method for manufacturing thin-specification high-Ti wear-resistant steel NM450 comprises the steps of:

(1) slagging off qualified melted iron with a temperature greater than 1250° C. and a [S] no more than 0.020%, and removing S by KR according to requirements on a temperature, a weight and a sulfur content at a desulfurization end of incoming melted iron, wherein [S] is no more than 0.0020%, a whole-course argon blowing technology is employed, and an alkalinity of final slags ranges from 3.0 to 4.0;

(2) smelting the melted iron in a converter, using pellet as a coolant, and adding the pellet and oxidized scale according to relevant regulations; and adding fluorite in a small amount in batches according to slag situations in the converter, wherein no more than 4 kg of fluorite is added in each ton of steel and no more than 5.5 kg of fluorite is added in each ton of steel during double slag, adding the fluorite 2 min before a blowing end point is strictly forbidden, double slag cutoff tapping is performed by using a slag-blocking awl and a slag-blocking plug, a slag thickness is no more than 50 mm, and deoxidizing is performed by a step-by-step deoxidation technology in the course of converter tapping;

(3) feeding the melted steel to a LF refining station, and after the melted steel enters the refining station, stirring the melted steel by argon at a flow rate of 300 NL/min to 800 NL/min for 1 min to 2 min to facilitate melting slag; inserting a graphite electrode into the melted steel, supplying power to raise a temperature, blowing argon into the melted steel at the same time at an argon blowing flow rate of 100 NL/min to 400 NL/min, and blowing the argon for 4 min to 10 min, wherein the argon blowing flow rate ranges from 100 NL/min to 450 NL/min when desulfurizing the melted steel, and the temperature is measured after blowing the argon for 4 min to 10 min; the argon blowing flow rate ranges from 100 NL/min to 400 NL/min during sampling; and an argon blowing pressure ranges from 1.2 MPa to 1.8 MPa, slagging materials are added into the melted steel for slagging while refining the melted steel, and desulfurization refining and inclusion removal are performed to control a binary alkalinity $R(CaO/SiO_2)$ in the slag to range from 1.3 to 2.8, and make FeO+MnO in the slag be less than 2.0%, and the melted steel leaving the station [S] be no more than 0.008%;

(4) refining the melted steel in a RH furnace, and after the melted steel reaches the RH furnace, opening a steel ladle to a position to be processed, and measuring a clearance height, a slag thickness and a temperature of the steel ladle, wherein a clearance of the steel ladle is controlled to range from 300 mm to 700 mm, a top slag thickness of the melted steel is controlled to be less than 100 mm, and the temperature of the melted steel is 1615° C. to 1630° C.; lifting the steel ladle according to the clearance height and the slag thickness of the steel ladle to ensure that an insertion depth of a stinger into the melted steel is no less than 600 mm, and finely adjusting alloying components according to the temperature, an oxygen content and steel sample components, with an alloying sequence of adding AL alloy first, then adding SiFe, MnFe, CrFe, MoFe and NbFe, circulating the alloys for 3 min under a limit vacuum degree after the alloys are added, and performing temperature measurement, sampling and oxygen determination; wherein an oxygen content [0] in the steel needs to be controlled below 3 ppm after alloying, the temperature needs to be controlled to range from 1590° C. to 1600° C., an aluminum wire and a titanium wire or Ti alloy is fed in turn before the melted steel refined in the RH furnance leaves the station, and components of $Al_S$ and Ti are adjusted, and finally B is microalloyed;

(5) performing conventional slab continuous casting for the melted steel, employing a double-layer covering agent on a surface of melted steel in a tundish, adding sufficient alkaline covering agent on a lower layer, adding a low-carbon acidic covering agent on an upper layer, and employing constant weight operation on the tundish; employing long nozzle casting and argon protection on the melted steel from a bale to the tundish, using a special medium carbon wear-resistant steel mould flux, controlling a degree of superheat to range from 15° C. to 30° C., putting in a mould for electromagnetic stirring during the continuous casting, and employing a continuous casting soft reduction technology in a sector section, wherein a continuous casting drawing speed is controlled to range from 1.0 m/min to 1.2 m/min, a thickness of the slab for continuous casting is controlled to be 220 mm, and chemical components of the slab obtained after conventional slab continuous casting and contents thereof are as follows: 0.16 wt % to 0.20 wt % of C, 0.2 wt % to 0.4 wt % of Si, 0.8 wt % to 1.5 wt % of Mn, 0.10 wt % to 0.20 wt % of Mo, 0.30 wt % to 0.50 wt % of Cr, 0.02 wt % to 0.05 wt % of Nb, 0.10 wt % to 0.15 wt % of Ti, 0.0005 wt % to 0.0010 wt % of B, less than 0.015 wt % of P, less than 0.010 wt % of S, and the remaining of Fe and inevitable impurities; and cooling the slab to a room temperature, inspecting a quality and a surface of the slab, and removing a layer of coat on the surface of the slab for continuous casting;

(6) feeding the slab into a furnace for heating, wherein a heating time in the heating furnace is no less than 240 min, a heating temperature ranges from 1180° C. to 1260° C., a temperature of the slab leaving the heating furnace is no less than 1150° C., and two-stage controlled rolling is employed; rolling a recrystallization zone, reducing rolling passes under conditions allowed by equipment, and increasing a reduction rate of the rolling passes; and appropriately prolonging a residence time after rolling to increase a recrystallization amount of deformed Austenite, thus homogenizing the structure;

(7) dephosphorizing the slab by high-pressure water after the slab leaves the heating furnace, wherein a dephosphorizing pressure is no less than 16 MPa;

(8) performing rough rolling for 5 passes to 9 passes after dephosphorizing, performing Austenite finish rolling in a non-recrystallization zone after reducing the temperature of the steel to 900° C. to 950° C. after rough rolling to ensure that a total reduction rate of the non-recrystallization zone is greater than 45%, and appropriately increasing a pass reduction rate according to a rolling capacity, wherein a reduction rate of 3 passes before finish rolling is particularly controlled to be no less than 50%, so as to create favorable conditions for the subsequent transformation nucleation of the Austenite to a ferrite and increase nucleation parts, so as to achieve the purpose of refining ferrite grains, a final rolling temperature is controlled to range from 820° C. to 860° C., and a reduction rate of the last pass is controlled to be no more than 12% to ensure an accurate thickness and a good plate shape;

(9) cooling rolled piece by an ultra fast cooling device after the rolled piece leaves a rolling mill, wherein a cooling rate ranges from 15° C./s to 30° C./s, and a quenching termination temperature ranges from 550° C. to 650° C.;

(10) coiling the rolled piece by a coiler, and performing stacking and cooling;

(11) feeding the rolled piece to a heat processing workshop for flattening;

(12) performing shot blasting processing on the steel plates to remove oxidized scale on a surface;

(13) heating the steel plate to 900° C. to 950° C. in a heat processing furnace after flattening, keeping a temperature for 1.5 h to 2 h, and quenching;

(14) Tempering after cooling the temperature to 300° C. to 400° C.; and

(15) finishing and inspecting the steel plate in a finishing set.

Further, in the step (2), same steel grades cannot be smelt in first six furnaces of the converter before new blowing-in and first two furnaces after large patching.

Further, in the step (6), the heating time in the heating furnace is no less than 60 min, and the heating temperature ranges from 1050° C. to 1150° C.

Further, in the step (8), a thickness of an outlet of the rolling mill ranges from 6 mm to 12 mm, and a temperature of a finish rolling outlet ranges from 860° C. to 920° (Further, the step-by-step deoxidization technology in the step (2) comprises the following steps of: adding a composite deoxidizer and a metal aluminum block into the steel ladle in the course of converter tapping, and primarily deoxidizing the melted steel, wherein an addition amount of the composite deoxidizer and an addition amount of the metal aluminum block are determined according to a dissolved oxygen content at an end point of the melted steel and a target oxygen content after primary deoxidization; adding low-carbon ferromanganese, ferrosilicon, ferromolybdenum and ferrochrome into the steel ladle; performing whole-course argon blowing on the melted steel in the steel ladle, measuring the temperature of the melted steel after blowing argon for 3 min to 8 min, performing oxygen determination and feeding the aluminum wire into the melted steel according to the oxygen content of the melted steel for final deoxidation and aluminizing of the melted steel, and keep blowing argon for 2 min to 10 min.

Further, the slagging materials in the step (3) comprise lime, synthetic slag, pre-dissolved slag or a slag regulator.

Further, in the step (12), a shot blasting speed is no more than 2 in/min to 4 m/min, and a roughness of the steel plate after shot blasting ranges from 25 μm to 55 μM.

Compared with the prior art, the present invention adopts a reasonable alloying design, selects a low-cost and high-Ti microalloying technology, and controls a micro-structure through ultra fast cooling and quenching after two-stage controlled rolling, thus giving full play to the role of strengthening an alloy performance, and reducing the addition amount of the alloy and the use amount of the precious alloys, and compared with the traditional technology, the method reduces the addition amount of the precious alloys and improves a toughness ratio of steel, thus saving social resources and reducing production costs.

DETAILED DESCRIPTION

The present invention is further described below with reference to the specific embodiments which are not intended to limit the protection scope of the present invention.

Embodiment 1

A method for manufacturing thin-specification high-Ti wear-resistant steel NM450 comprises the steps of:

(1) slagging off qualified melted iron with a temperature greater than 1250° C. and a [S] no more than 0.020% (a mass percentage of S in the melted iron), and removing S by KR according to requirements on a temperature, a weight and a sulfur content at a desulfurization end of incoming melted iron, wherein [S] is 0.0010%, a whole-course argon blowing technology is employed, and an alkalinity of final slags is 3.0;

(2) smelting the melted iron in a converter, using pellet as a coolant, and adding the pellet and oxidized scale according to relevant regulations; and adding fluorite in a small amount in batches according to slag situations in the converter, wherein 3.9 kg of fluorite is added in each ton of steel, adding the fluorite 2 min before a blowing end point is strictly forbidden, double slag cutoff tapping is performed by using a slag-blocking awl and a slag-blocking plug, a slag thickness is 48 mm, and deoxidizing is performed by a step-by-step deoxidation technology in the course of converter tapping: adding a composite deoxidizer and a metal aluminum block into the steel ladle in the course of converter tapping, and primarily deoxidizing the melted steel; then adding low-carbon ferromanganese, ferrosilicon, ferromolybdenum and ferrochrome into the steel ladle, performing whole-course argon blowing on the melted steel in the steel ladle, measuring the temperature of the melted steel alter blowing argon for 8 min, performing oxygen determination and sampling, feeding the aluminum wire into the melted steel according to the oxygen content of the melted steel for final deoxidation and aluminizing of the melted steel, and keep blowing argon for 10 min;

(3) feeding the melted steel to a LF refining station, and after the melted steel enters the refining station, stirring the melted steel by argon at a flow rate of 780 NL/min for 1.2 min for melting slag; inserting a graphite electrode into the melted steel, supplying power to raise a temperature, blowing argon into the melted steel at the same time at an argon blowing flow rate of 390 NL/min, and blowing the argon for 4.5 min, wherein the argon blowing flow rate is 450 NL/min when desulfurizing the melted steel, and the temperature is measured after blowing the argon for 4 min; the argon blowing flow rate is 200 NL/min during sampling; and an argon blowing pressure is 1.4 MPa, slagging materials are added into the melted steel for slagging while refining the melted steel, such as lime, synthetic slag, pre-dissolved slag or a slag regulator; and desulfurization refining and inclusion removal are performed to control a binary alkalinity $R(CaO/SiO_2)$ in the slag to be 1.5, and make FeO+MnO in the slag be less than 2.0%, and the melted steel leaving the station [S] be 0.003%;

(4) refining the melted steel in a RH furnace, and after the melted steel reaches the RH furnace, opening a steel ladle to a position to be processed, and measuring a clearance height, a slag thickness and a temperature of the steel ladle, wherein a clearance of the steel ladle is controlled to be 350 mm, a top slag thickness of the melted steel is 90 mm, and the temperature of the melted steel is 1620° C.; inserting a stinger into the melted steel with an insertion depth of 650 mm, mm, and finely adjusting alloying components according to the temperature, an oxygen content and steel sample components, with an alloying sequence of adding AL alloy first, then adding SiFe, MnFe, CrFe, MoFe and NbFe, circulating the alloys for 3 min under a limit vacuum degree after the alloys are added, and performing temperature measurement, sampling and oxygen determination; wherein, an oxygen content [O] (a mass percentage of 0 in the melted steel) in the steel needs to be controlled to be 2 ppm after alloying, the temperature is controlled to be 1595° C., an aluminum wire and a titanium wire or Ti alloy is fed in turn before the melted steel refined in the RH furnance leaves the station, and components of $Al_S$ and Ti are adjusted, and finally B is microalloyed;

(5) performing conventional slab continuous casting for the melted steel, employing a double-layer covering agent on a surface of melted steel in a tundish, adding sufficient alkaline covering agent on a lower layer, adding a low-carbon acidic covering agent on an upper layer, and employing constant weight operation on the tundish; employing long nozzle casting and argon protection on the melted steel from a bale to the tundish, using a special medium carbon wear-resistant steel mould flux, controlling a degree of superheat to be 20° C., putting in a mould for electromagnetic stirring during the continuous casting, and employing a continuous casting soft reduction technology in a sector section, wherein a continuous casting drawing speed is controlled to be 1.0 m/min, and a thickness of the slab for continuous casting is controlled to be 220 mm; and cooling the slab to a room temperature, inspecting a quality and a surface of the slab, and removing a layer of coat on the surface of the slab for continuous casting;

(6) feeding the slab into a furnace for heating, wherein a heating time in the heating furnace is 280 min, a heating temperature is 1250° C., a temperature of the slab leaving the heating furnace is 1160° C., and two-stage controlled rolling is employed; rolling a recrystallization zone, reducing rolling passes under conditions allowed by equipment, and increasing a reduction rate of the rolling passes; and appropriately prolonging a residence time after rolling to increase a recrystallization amount of deformed Austenite, thus homogenizing the structure;

(7) dephosphorizing the slab by high-pressure water after the slab leaves the heating furnace, wherein a dephosphorizing pressure is 18 MPa;

(8) performing rough rolling for 9 passes after dephosphorizing, performing Austenite finish rolling in a non-recrystallization zone after reducing the temperature of the steel to 900° C. after rough rolling to ensure that a total reduction rate of the non-recrystallization zone is greater than 45%, and appropriately increasing a pass reduction rate according to a rolling capacity, wherein a reduction rate of 3 passes before finish rolling is particularly controlled to be no less than 50%, so as to create favorable conditions for the subsequent transformation nucleation of the Austenite to a ferrite and increase nucleation parts, so as to achieve the purpose of refining ferrite grains, a reduction rate of the last pass is 6% to ensure an accurate thickness and a good plate shape, a thickness of an outlet of the rolling mill is 12 mm, and a temperature of a finish rolling outlet is 820° C.;

(9) cooling rolled piece by an ultra fast cooling device after the rolled piece leaves a rolling mill, wherein a cooling rate is 15° C./s, and a quenching termination temperature is 550° C.;

(10) coiling the rolled piece by a coiler, and performing stacking and cooling;

(11) feeding the rolled piece to a heat processing workshop for flattening, wherein a temperature of a steel coil during flattening is 20° C.;

(12) performing shot blasting processing on the steel plates to remove oxidized scale on a surface, wherein a shot blasting speed is 4 m/min, and a roughness of the steel plate after shot blasting is 55 μm;

(13) heating the steel plate to 950° C. in a heat processing furnace after flattening, keeping a temperature for 1.5 h, and quenching;

(14) tempering after cooling the temperature to 300° C.; and

(15) finishing and inspecting the steel plate in a finishing set.

In the embodiment, chemical components of the slab obtained after conventional slab continuous casting and contents thereof in the step (5) are as follows: 0.16 wt % of C, 0.4 wt % of Si, 1.5 wt % of Mn, 0.20 wt % of Mo, 0.32 wt % of Cr, 0.031 wt % of Nb, 0.11 wt % of Ti, 0.0006 wt % of B, 0.010 wt % of P, 0.002 wt % of S, and the remaining of Fe and inevitable impurities. The thin-specification high-Ti wear-resistant steel N M450 provided by the embodiment has a yield strength of 985 MPa, a tensile strength of 1195 MPa, an $A_{50}$ elongation of 13.5%, and a surface Brinell hardness of 370 HBW, and under the condition of −20° C., a Charpy V-shaped impact energy is 78 J, 76 J and 80 J respectively, and a performance thereof meets technical conditions of national standard GB/T24186-2009 of NM450.

Embodiment 2

A method for manufacturing thin-specification high-Ti wear-resistant steel NM450 comprises the steps of:

(1) slagging off qualified melted iron with a temperature greater than 1250° C. and a [S] no more than 0.020% (a mass percentage of S in the melted iron), and removing S by KR according to requirements on a temperature, a weight and a sulfur content at a desulfurization end of incoming melted iron, wherein [S] is 0.0010%, a whole-course argon blowing technology is employed, and an alkalinity of final slags is 3.5;

(2) smelting the melted iron in a converter, using pellet as a coolant, and adding the pellet and oxidized scale according to relevant regulations; and adding fluorite in a small amount in batches according to slag situations in the converter, wherein 3.2 kg of fluorite is added in each ton of steel, adding the fluorite 2 min before a blowing end point is strictly forbidden, double slag cutoff tapping is performed by using a slag-blocking awl and a slag-blocking plug, a slag thickness is 45 mm, and deoxidizing is performed by a step-by-step deoxidation technology in the course of converter tapping: adding a composite deoxidizer and a metal aluminum block into the steel ladle in the course of converter tapping, and primarily deoxidizing the melted steel; then adding low-carbon ferromanganese, ferrosilicon, ferromolybdenum and ferrochrome into the steel ladle, performing whole-course argon blowing on the melted steel in the steel ladle, measuring the temperature of the melted steel after blowing argon for 5 min, performing oxygen determination and sampling, feeding the aluminum wire into the melted steel according to the oxygen content of the melted steel for final deoxidation and aluminizing of the melted steel, and keep blowing argon for 2 min;

(3) feeding the melted steel to a LF refining station, and after the melted steel enters the refining station, stirring the melted steel by argon at a flow rate of 500 NL/min for 1.5 min for melting slag; inserting a graphite electrode into the melted steel, supplying power to raise a temperature, blowing argon into the melted steel at the same time at an argon blowing flow rate of 350 NL/min, and blowing the argon for 6 min, wherein the argon blowing flow rate is 400 NL/min when desulfurizing the melted steel, and the temperature is measured after blowing the argon for 8 min; the argon blowing flow rate is 250 NL/min during sampling; and an argon blowing pressure is 1.2 MPa, slagging materials are added into the melted steel for slagging while refining the melted steel, such as lime, synthetic slag, pre-dissolved slag or a slag regulator; and desulfurization refining and inclusion removal are performed to control a binary alkalinity $R(CaO/SiO_2)$ in the slag to be 2.8, and make FeO+MnO in the slag be less than 2.0%, and the melted steel leaving the station [S] be 0.004%;

(4) refining the melted steel in a RH furnace, and after the melted steel reaches the RH furnace, opening a steel ladle to a position to be processed, and measuring a clearance height, a slag thickness and a temperature of the steel ladle, wherein a clearance of the steel ladle is controlled to be 350 mm, a top slag thickness of the melted steel is 90 mm, and the temperature of the melted steel is 1615° C.; inserting a stinger into the melted steel with an insertion depth of 650 mm, and finely adjusting alloying components according to the temperature, an oxygen content and steel sample components, with an alloying sequence of adding AL alloy first, then adding SiFe, MnFe, CrFe, MoFe and NbFe, circulating the alloys for 3 min under a limit vacuum degree after the alloys are added, and performing temperature measurement, sampling and oxygen determination; wherein, an oxygen content [0] in the steel needs to be controlled to be 2 ppm after alloying, the temperature is controlled to be 1595° C., an aluminum wire and a titanium or Ti alloy is fed in turn before the melted steel refined in the RH furnance leaves the station, and components of $Al_S$ and Ti are adjusted, and finally B is microalloyed;

(5) performing conventional slab continuous casting for the melted steel, employing a double-layer covering agent on a surface of melted steel in a tundish, adding sufficient alkaline covering agent on a lower layer, adding a low-carbon acidic covering agent on an upper layer, and employing constant weight operation on the tundish; employing long nozzle casting and argon protection on the melted steel from a bale to the tundish, using a special medium carbon wear-resistant steel mould flux, controlling a degree of superheat to be 15° C., putting in a mould for electromagnetic stirring during the continuous casting, and employing a continuous casting soft reduction technology in a sector section, wherein a continuous casting drawing speed is controlled to be 1.2 m/min, and a thickness of the slab for continuous casting is controlled to be 220 mm; and cooling the slab to a room temperature, inspecting a quality and a surface of the slab, and removing a layer of coat on the surface of the slab for continuous casting;

(6) feeding the slab into a furnace for heating, wherein a heating time in the heating furnace is 300 min, a heating temperature is 1200° C., a temperature of the slab leaving the heating furnace is 1180° C., and two-stage controlled rolling is employed; rolling a recrystallization zone, reducing rolling passes under conditions allowed by equipment, and increasing a reduction rate of the rolling passes; and appropriately prolonging a residence time after rolling to increase a recrystallization amount of deformed Austenite, thus homogenizing the structure;

(7) dephosphorizing the slab by high-pressure water after the slab leaves the heating furnace, wherein a dephosphorizing pressure is 20 MPa;

(8) performing rough rolling for 7 passes after dephosphorizing, performing Austenite finish rolling in a non-recrystallization zone after reducing the temperature of the steel to 900° C. after rough rolling to ensure that a total reduction rate of the non-recrystallization zone is greater than 45%, and appropriately increasing a pass reduction rate according to a rolling capacity, wherein a reduction rate of 3 passes before finish rolling is particularly controlled to be no less than 50%, so as to create favorable conditions for the subsequent transformation nucleation of the Austenite to a ferrite and increase nucleation parts, so as to achieve the purpose of refining ferrite grains, a reduction rate of the last pass is 7.3% to ensure an accurate thickness and a good plate shape, a thickness of an outlet of the rolling mill is 6 mm, and a temperature of a finish rolling outlet is 860° C.;

(9) cooling rolled piece by an ultra fast cooling device after the rolled piece leaves a rolling mill, wherein a cooling rate is 30° C./s, and a quenching termination temperature is 500° C.;

(10) coiling the rolled piece by a coiler, and performing stacking and cooling;

(11) feeding the rolled piece to a heat processing workshop for flattening, wherein a temperature of a steel coil during flattening is 60° C.;

(12) performing shot blasting processing on the steel plates to remove oxidized scale on a surface, wherein a shot blasting speed is 2 m/min, and a roughness of the steel plate after shot blasting is 30 μm;

(13) heating the steel plate to 900° C. in a heat processing furnace after flattening, keeping a temperature for 2 h, and quenching;

(14) tempering after cooling the temperature to 350° C.; and

(15) finishing and inspecting the steel plate in a finishing set.

In the embodiment, chemical components of the slab obtained after conventional slab continuous casting and contents thereof in the step (5) are as follows: 0.20 wt % of C, 0.20 wt % of Si, 0.85 wt % of Mn, 0.20 wt % of Mo, 0.50 wt % of Cr, 0.045 wt % of Nb, 0.15 wt % of Ti, 0.0010 wt % of B, 0.011 wt % of P, 0.002 wt % of S, and the remaining of Fe and inevitable impurities. The thin-specification high-Ti wear-resistant steel NM450 provided by the embodiment has a yield strength of 1010 MPa, a tensile strength of 1215 MPa, an $A_{50}$ elongation of 14.5%, and a surface Brinell hardness of 367 HBW, and under the condition of −20° C., a Charpy V-shaped impact energy is 82 J, 83 J and 89 J respectively, and a performance thereof meets technical conditions of national standard GB/T24186-2009 of NM450.

Embodiment 3

A method for manufacturing thin-specification high-Ti wear-resistant steel NM450 comprises the steps of:

(1) slagging off qualified melted iron with a temperature greater than 1250° C. and a [S] no more than 0.020% (a mass percentage of S in the melted iron), and removing S by KR according to requirements on a temperature, a weight and a sulfur content at a desulfurization end of incoming melted iron, wherein [S] is 0.0010%, a whole-course argon blowing technology is employed, and an alkalinity of final slags is 3.0;

(2) smelting the melted iron in a converter, using pellet as a coolant, and adding the pellet and oxidized scale according to relevant regulations; and adding fluorite in a small amount in batches according to slag situations in the converter, wherein 3.2 kg of fluorite is added in each ton of steel, adding the fluorite 2 min before a blowing end point is strictly forbidden, double slag cutoff tapping is performed by using a slag-blocking awl and a slag-blocking plug, a slag thickness is 40 mm, and deoxidizing is performed by a step-by-step deoxidation technology in the course of converter tapping: adding a composite deoxidizer and a metal aluminum block into the steel ladle in the course of converter tapping, and primarily deoxidizing the melted steel; then adding low-carbon ferromanganese, ferrosilicon, ferromolybdenum and ferrochrome into the steel ladle, performing whole-course argon blowing on the melted steel in the steel ladle, measuring the temperature of the melted steel after blowing argon for 10 min, performing oxygen determination and sampling, feeding the aluminum wire into the melted steel according to the oxygen content of the melted steel for final deoxidation and aluminizing of the melted steel, and keep blowing argon for 2 min;

(3) feeding the melted steel to a LF refining station, and after the melted steel enters the refining station, stirring the melted steel by argon at a flow rate of 400 NL/min for 2 min for melting slag; inserting a graphite electrode into the melted steel, supplying power to raise a temperature, blowing argon into the melted steel at the same time at an argon blowing flow rate of 350 NL/min, and blowing the argon for 8 min, wherein the argon blowing flow rate is 320 NL/min when desulfurizing the melted steel, and the temperature is measured after blowing the argon for 8 min; the argon blowing flow rate is 250 NL/min during sampling; and an argon blowing pressure is 1.2 MPa, slagging materials are added into the melted steel for slagging while refining the melted steel, such as lime, synthetic slag, pre-dissolved slag or a slag regulator; and desulfurization refining and inclusion removal are performed to control a binary alkalinity $R(CaO/SiO_2)$ in the slag to be 2.0, and make FeO+MnO in the slag be less than 2.0%, and the melted steel leaving the station [S] be 0.003%;

(4) refining the melted steel in a RH furnace, and after the melted steel reaches the RH furnace, opening a steel ladle to a position to be processed, and measuring a clearance height, a slag thickness and a temperature of the steel ladle, wherein a clearance of the steel ladle is controlled to be 300 mm, a top slag thickness of the melted steel is 80 mm, and the temperature of the melted steel is 1625° C.; inserting a stinger into the melted steel with an insertion depth of 660 mm, and finely adjusting alloying components according to the temperature, an oxygen content and steel sample components, with an alloying sequence of adding AL alloy first, then adding SiFe, MnFe, CrFe, MoFe and NbFe, circulating the alloys for 3 min under a limit vacuum degree after the alloys are added, and performing temperature measurement, sampling and oxygen determination; wherein, an oxygen content [0] in the steel needs to be controlled to be 2 ppm after alloying, the temperature is controlled to be 1599° C., an aluminum wire and a titanium wire or Ti alloy is fed in turn before the melted steel refined in the RH furnance leaves the station, and components of $Al_S$ and Ti are adjusted, and finally B is microalloyed;

(5) performing conventional slab continuous casting for the melted steel, employing a double-layer covering agent on a surface of melted steel in a tundish, adding sufficient alkaline covering agent on a lower layer, adding a low-carbon acidic covering agent on an upper layer, and employing constant weight operation on the tundish; employing long nozzle casting and argon protection on the melted steel from a bale to the tundish, using a special medium carbon wear-resistant steel mould flux, controlling a degree of superheat to be 30° C., putting in a mould for electromagnetic stirring during the continuous casting, and employing a continuous casting soft reduction technology in a sector section, wherein a continuous casting drawing speed is controlled to be 1.1 m/min, and a thickness of the slab for continuous casting is controlled to be 220 mm; and cooling the slab to a room temperature, inspecting a quality and a surface of the slab, and removing a layer of coat on the surface of the slab for continuous casting;

(6) feeding the slab into a furnace for heating, wherein a heating time in the heating furnace is 300 min, a heating temperature is 1180° C., a temperature of the slab leaving the heating furnace is 1160° C., and two-stage controlled rolling is employed; rolling a recrystallization zone, reducing rolling passes under conditions allowed by equipment, and increasing a reduction rate of the rolling passes; and appropriately prolonging a residence time after rolling to increase a recrystallization amount of deformed Austenite, thus homogenizing the structure;

(7) dephosphorizing the slab by high-pressure water after the slab leaves the heating furnace, wherein a dephosphorizing pressure is 16 MPa;

(8) performing rough rolling for 5 passes after dephosphorizing, performing Austenite finish rolling in a non-recrystallization zone after reducing the temperature of the steel to 950° C. after rough rolling to ensure that a total reduction rate of the non-recrystallization zone is greater than 45%, and appropriately increasing a pass reduction rate according to a rolling capacity, wherein a reduction rate of 3 passes before finish rolling is particularly controlled to be no less than 50%, so as to create favorable conditions for the subsequent transformation nucleation of the Austenite to a ferrite and increase nucleation parts, so as to achieve the purpose of refining ferrite grains, a finish rolling temperature is controlled to be close to a phase transition temperature of Ar3, a reduction rate of the last pass is 7.3% to ensure an accurate thickness and a good plate shape, a thickness of an outlet of the rolling mill is 8 mm, and a temperature of a finish rolling outlet is 840° C.;

(9) cooling rolled piece by an ultra fast cooling device after the rolled piece leaves a rolling mill, wherein a cooling rate is 25° C./s, and a quenching termination temperature is 550° C.;

(10) coiling the rolled piece by a coiler, and performing stacking and cooling;

(11) feeding the rolled piece to a heat processing workshop for flattening, wherein a temperature of a steel coil during flattening is 30° C.;

(12) performing shot blasting processing on the steel plates to remove oxidized scale on a surface, wherein a shot blasting speed is 4 in/min, and a roughness of the steel plate after shot blasting is 35 μm;

(13) heating the steel plate to 900° C. in a heat processing furnace after flattening, keeping a temperature for 2 h, and quenching;

(14) tempering after cooling the temperature to 350° C.; and

(15) finishing and inspecting the steel plate in a finishing set.

In the embodiment, chemical components of the slab obtained after conventional slab continuous casting and contents thereof in the step (5) are as follows: 0.18 wt % of C, 0.25 wt % of Si, 1.5 wt % of Mn, 0.15 wt % of Mo, 0.45 wt % of Cr, 0.050 wt % of Nb, 0.10 wt % of Ti, 0.0007 wt % of B, 0.010 wt % of P, 0.002 wt % of S, and the remaining of Fe and inevitable impurities. The thin-specification high-Ti wear-resistant steel NM450 provided by the embodiment has a yield strength of 1015 MPa, a tensile strength of 1295 MPa, an $A_{50}$ elongation of 13.5%, and a surface Brinell hardness of 385 HBW, and under the condition of −20° C., a Charpy V-shaped impact energy is 64 J, 60 J and 65 J respectively, and a performance thereof meets technical conditions of national standard GB/T24186-2009 of NM450.

Embodiment 4

A method for manufacturing thin-specification high-Ti wear-resistant steel NM450 comprises the steps of:

(1) slagging off qualified melted iron with a temperature greater than 1250° C. and a [S] no more than 0.020% (a mass percentage of S in the melted iron), and removing S by KR according to requirements on a temperature, a weight and a sulfur content at a desulfurization end of incoming melted iron, wherein [S] is 0.0010%, a whole-course argon blowing technology is employed, and an alkalinity of final slags is 3.5;

(2) smelting the melted iron in a converter, using pellet as a coolant, and adding the pellet and oxidized scale according to relevant regulations; and adding fluorite in a small amount in batches according to slag situations in the converter, wherein 3.5 kg of fluorite is added in each ton of steel, adding the fluorite 2 min before a blowing end point is strictly forbidden, double slag cutoff tapping is performed by using a slag-blocking awl and a slag-blocking plug, a slag slag thickness is 40 mm, and deoxidizing is performed by a step-by-step deoxidation technology in the course of converter tapping: adding a composite deoxidizer and a metal aluminum block into the steel ladle in the course of converter tapping, and primarily deoxidizing the melted steel; then adding low-carbon ferromanganese, ferrosilicon, ferromolybdenum and ferrochrome into the steel ladle, performing whole-course argon blowing on the melted steel in the steel ladle, measuring the temperature of the melted steel after blowing argon for 10 min, performing oxygen determination and sampling, feeding the aluminum wire into the melted steel according to the oxygen content of the melted steel for final deoxidation and aluminizing of the melted steel, and keep blowing argon for 2 min;

(3) feeding the melted steel to a LF refining station, and after the melted steel enters the refining station, stirring the melted steel by argon at a flow rate of 400 NL/min for 2 min for melting slag; inserting a graphite electrode into the melted steel, supplying power to raise a temperature, blowing argon into the melted steel at the same time at an argon blowing flow rate of 350 NL/min, and blowing the argon for 8 min, wherein the argon blowing flow rate is 100 NL/min when desulfurizing the melted steel, and the temperature is measured after blowing the argon for 8 min; the argon blowing flow rate is 250 NL/min during sampling; and an argon blowing pressure is 1.2 MPa, slagging materials are added into the melted steel for slagging while refining the melted steel, such as lime, synthetic slag, pre-dissolved slag or a slag regulator; and desulfurization refining and inclusion removal are performed to control a binary alkalinity $R(CaO/SiO_2)$ in the slag to be 2.0, and make FeO+MnO in the slag be less than 2.0%, and the melted steel leaving the station [S] be 0.003%;

(4) fefining the melted steel in a RH furnace, and after the melted steel reaches the RH furnace, opening a steel ladle to a position to be processed, and measuring a clearance height, a slag thickness and a temperature of the steel ladle, wherein a clearance of the steel ladle is controlled to be 300 mm, a top slag thickness of the melted steel is 80 mm, and the temperature of the melted steel is 1630° C.; inserting a stinger into the melted steel with an insertion depth of 665 mm, and finely adjusting alloying components according to the temperature, an oxygen content and steel sample components, with an alloying sequence of adding AL alloy first, then adding SiFe, MnFe, CrFe, MoFe and NbFe, circulating the alloys for 3 min under a limit vacuum degree after the alloys are added, and performing temperature measurement, sampling and oxygen determination; wherein, an oxygen content [0] in the steel needs to be controlled to be 2 ppm after alloying, the temperature is controlled to be 1595° C., an aluminum wire and a titanium wire or Ti alloy is fed in turn before the melted steel refined in the RH furnance leaves the station, and components of $Al_S$ and Ti are adjusted, and finally B is microalloyed;

(5) performing conventional slab continuous casting for the melted steel, employing a double-layer covering agent on a surface of melted steel in a tundish, adding sufficient alkaline covering agent on a lower layer, adding a low-carbon acidic covering agent on an upper layer, and employing constant weight operation on the tundish; employing long nozzle casting and argon protection on the melted steel from a bale to the tundish, using a special medium carbon wear-resistant steel mould flux, controlling a degree of superheat to be 30° C., putting in a mould for electromagnetic stirring during the continuous casting, and employing a continuous casting soft reduction technology in a sector section, wherein a continuous casting drawing speed is controlled to be 1.1 m/min, and a thickness of the slab for continuous casting is controlled to be 220 mm; and cooling the slab to a room temperature, inspecting a quality and a surface of the slab, and removing a layer of coat on the surface of the slab for continuous casting;

(6) feeding the slab into a furnace for heating, wherein a heating time in the heating furnace is 300 min, a heating temperature is 1200° C., a temperature of the slab leaving the heating furnace is 1160° C., and two-stage controlled rolling is employed; rolling a recrystallization zone, reducing rolling passes under conditions allowed by equipment, and increasing a reduction rate of the rolling passes; and appropriately prolonging a residence time after rolling to increase a recrystallization amount of deformed Austenite, thus homogenizing the structure;

(7) dephosphorizing the slab by high-pressure water after the slab leaves the heating furnace, wherein a dephosphorizing pressure is 18 MPa;

(8) performing rough rolling for 5 passes after dephosphorizing, performing Austenite finish rolling in a non-recrystallization zone after reducing the temperature of the steel to 950° C. after rough rolling to ensure that a total reduction rate of the non-recrystallization zone is greater than 45%, and appropriately increasing a reduction rate according to a rolling capacity, wherein a reduction rate of 3 passes before finish rolling is particularly controlled to be no less than 50%, so as to create favorable conditions for the subsequent transformation nucleation of the Austenite to a ferrite and increase nucleation parts, so as to achieve the purpose of refining ferrite grains, a reduction rate of the last pass is 8% to ensure an accurate thickness and a good plate shape, a thickness of an outlet of the rolling mill is 10 mm, and a temperature of a finish rolling outlet is 860° C.;

(9) cooling rolled piece by an ultra fast cooling device after the rolled piece leaves a rolling mill, wherein a cooling rate is 20° C./s, and a quenching termination temperature is 550° C.;

(10) coiling the rolled piece by a coiler, and performing stacking and cooling;

(11) feeding the rolled piece to a heat processing workshop for flattening, wherein a temperature of a steel coil during flattening is 30° C.;

(12) performing shot blasting processing on the steel plates to remove oxidized scale on a surface, wherein a shot blasting speed is 3 m/min, and a roughness of the steel plate after shot blasting is 40 μm;

(13) heating the steel plate to 920° C. in a heat processing furnace after flattening, keeping a temperature for 1.5 h, and quenching;

(14) tempering after cooling the temperature to 300° C.; and

(15) finishing and inspecting the steel plate in a finishing set.

In the embodiment, chemical components of the slab obtained after conventional slab continuous casting and contents thereof in the step (5) are as follows: 0.18 wt % of C, 0.25 wt % of Si, 1.5 wt % of Mn, 0.15 wt % of Mo, 0.45 wt % of Cr, 0.050 wt % of Nb, 0.10 wt % of Ti, 0.0007 wt % of B, 0.010 wt % of P, 0.002 wt % of S, and the remaining of Fe and inevitable impurities. The thin-specification high-Ti wear-resistant steel NM450 provided by the embodiment has a yield strength of 1015 MPa, a tensile strength of 1295 MPa, an $A_{50}$ elongation of 13.5%, and a surface Brinell hardness of 385 HBW, and under the condition of −20° C., a Charpy V-shaped impact energy is 64 J, 60 J and 65 J respectively, and a performance thereof meets technical conditions of national standard GB/T24186-2009 of NM450.

The embodiments of the present invention above are merely examples made for clearly illustrating the present invention instead of limiting the embodiments of the present invention. Those of ordinary skills in the art can make other different forms of changes or variations on the basis of the description above. It is neither necessary nor possible to exhaust all the embodiments here. All the modifications, equivalents, and improvements made within the spirit and principle of the present invention shall be included within the protection scope of the claims of the present invention.

The invention claimed is:

1. A method for manufacturing steel NM450, comprising the steps of:

(1) slagging off melted iron with a temperature greater than 1250° C. and a [S] no more than 0.020 mass %, and removing S by KR according to requirements on a temperature, a weight and a sulfur content at a desulfurization end of incoming melted iron, wherein [S] is no more than 0.0020 mass %, argon is employed by blowing, and an alkalinity of final slags ranges from 3.0 to 4.0;

(2) smelting the melted iron in a converter, and adding an amount of pellet as a coolant and an amount of oxidized scale; and adding fluorite in batches in the converter, wherein no more than 4 kg of fluorite is added in each ton of the melted iron or no more than 5.5 kg of fluorite is added in each ton of the melted iron during double slag, adding the fluorite during a last 2 min of a blow before a blowing end point is strictly forbidden, double slag cutoff tapping is performed by using a slag-blocking awl and a slag-blocking plug, a slag thickness is no more than 50 mm, and deoxidizing is performed by a step-by-step deoxidation technology in the course of converter tapping;

(3) feeding the melted steel to a LF refining station, and after the melted steel enters the refining station, stirring the melted steel by argon at a flow rate of 300 NL/min to 800 NL/min for 1 min to 2 min to facilitate melting slag; inserting a graphite electrode into the melted steel, supplying an amount of power to the graphite electrode to raise a temperature of the melted steel, blowing argon into the melted steel when supplying power at an argon blowing flow rate of 100 NL/min to 400 NL/min, and blowing the argon for 4 min to 10 min, wherein the argon blowing flow rate ranges from 100 NL/min to 450 NL/min when desulfurizing the melted steel, and the temperature of the melted steel is measured after blowing the argon for 4 min to 10 min; the argon blowing flow rate ranges from 100 NL/min to 400 NL/min during sampling; and an argon blowing pressure ranges from 1.2 MPa to 1.8 MPa during an LF refining step, slagging materials are added into the melted steel for slagging while refining the melted steel, and desulfurization refining and inclusion removal are performed to control a binary alkalinity $R(CaO/SiO_2)$ in the slag to range from 1.3 to 2.8, and make an amount of FeO+MnO in the slag be less than 2.0 mass %, and the melted steel leaving the station contains [S] of no more than 0.008 mass %;

(4) refining the melted steel in a RH furnace, and after the melted steel reaches the RH furnace, opening a steel ladle to a position to be processed, and measuring a clearance height of the steel ladle, a slag thickness of the melted steel and a temperature of the of the melted steel, wherein a clearance height of the steel ladle is controlled to range from 300 mm to 700 mm, a top slag thickness of the melted steel is controlled to be less than 100 mm, and the temperature of the melted steel is 1615° C. to 1630° C.; lifting the steel ladle according to the clearance height and the slag thickness of the steel ladle to ensure that an insertion depth of a stinger of the RH furnace into the melted steel is no less than 600 mm, and adjusting alloying components according to the temperature, an oxygen content and steel sample components, with an alloying sequence of adding AL alloy first, then adding SiFe, MnFe, CrFe, MoFe and NbFe, circulating the alloys for 3 min under a vacuum pressure after the alloys are added, and performing temperature measurement, sampling and oxygen determination; wherein, an oxygen content [0] in the steel needs to be controlled below 3 ppm after alloying, the temperature needs to be controlled to range from 1590° C. to 1600° C., an aluminum wire is fed and then a titanium wire or Ti alloy is fed before the melted steel refined in the RH furnance leaves the station, and components of AlS and Ti are adjusted, and finally B is microalloyed;

(5) performing slab continuous casting for the melted steel, employing a double-layer covering agent on a surface of melted steel in a tundish, adding an alkaline covering agent on a lower layer, adding an acidic covering agent on an upper layer, and employing constant weight operation on the tundish; employing long nozzle casting and argon protection on the melted steel from a bale to the tundish, using a steel mould flux, controlling a degree of superheat to range from 15° C. to 30° C., putting in a mould for electromagnetic stirring during the continuous casting, and employing a continuous casting soft reduction technology in a sector section, wherein a continuous casting drawing speed is controlled to range from 1.0 m/min to 1.2 m/min, a thickness of a slab is controlled to be 220 mm, and chemical components of the slab obtained after slab continuous casting and contents thereof are as follows: 0.16 wt % to 0.20 wt % of C, 0.2 wt % to 0.4 wt % of Si, 0.8 wt % to 1.5 wt % of Mn, 0.10 wt % to 0.20 wt % of Mo, 0.30 wt % to 0.50 wt % of Cr, 0.02 wt % to 0.05 wt % of Nb, 0.10 wt % to 0.15 wt % of Ti, 0.0005 wt % to 0.0010 wt % of B, less than 0.015 wt % of P, less than 0.010 wt % of S, and the remaining of Fe and inevitable impurities; and cooling the slab to a room temperature, inspecting a quality and a surface of the slab, and removing a layer with defects on the surface of the slab;

(6) feeding the slab into a furnace for heating, wherein a heating time in the heating furnace is no less than 240 min, a heating temperature ranges from 1180° C. to 1260° C., a temperature of the slab leaving the heating furnace is no less than 1150° C., and a two-stage controlled rolling is employed;

(7) dephosphorizing the slab by water after the slab leaves the heating furnace, wherein a dephosphorizing pressure of water is no less than 16 MPa;

(8) performing rough rolling for 5 passes to 9 passes after dephosphorizing, performing Austenite finish rolling in a non-recrystallization zone after reducing the temperature of the steel to 900° C. to 950° C. after rough rolling to ensure that a total reduction rate of the non-recrystallization zone is greater than 45%, and appropriately increasing a pass reduction rate according to rolling capacities of the rough rolling and the finish rolling, wherein a total reduction rate of a last 3 passes of the rough rolling before finish rolling is particularly controlled to be no less than 50%, a final rolling temperature is controlled to range from 820° C. to 860° C., and a reduction rate of the last pass of the finish rolling is controlled to be no more than 12%;

(9) cooling a rolled piece obtained from step (8) by an ultra fast cooling device after the rolled piece leaves a rolling mill, wherein a cooling rate ranges from 15° C./s to 30° C./s, and a quenching termination temperature ranges from 550° C. to 650° C.;

(10) coiling the rolled piece by a coiler, and performing stacking and cooling;

(11) feeding the rolled piece to a heat processing workshop for flattening;

(12) performing shot blasting processing on steel plates obtained from step (11) to remove oxidized scale on a surface;

(13) heating the steel plate to 900° C. to 950° C. in a heat processing furnace after flattening, keeping a temperature for 1.5 h to 2 h, and quenching;

(14) after quenching to cool the temperature of the steel plate to 300° C. to 400° C., performing a tempering process; and

(15) finishing and inspecting the steel plate in a finishing set.

2. The method for manufacturing steel NM450 according to claim 1, wherein in the step (2), same steel grades cannot be smelt in a first six furnaces of the converter before new blowing-in and a first two furnaces after patching.

3. The method for manufacturing steel NM450 according to claim 1, wherein in the step (8), a thickness of an outlet of the rolling mill ranges from 6 mm to 12 mm.

4. The method for manufacturing steel NM450 according to claim 1, wherein the step-by-step deoxidization technology in the step (2) comprises the following steps of: adding a composite deoxidizer and a metal aluminum block into the steel ladle in the course of converter tapping, and primarily deoxidizing the melted steel, wherein an addition amount of the composite deoxidizer and an addition amount of the metal aluminum block are determined according to a dissolved oxygen content at an end point of the melted steel and a target oxygen content after primary deoxidization; adding ferromanganese, ferrosilicon, ferromolybdenum and ferrochrome into the steel ladle; using argon blowing on the melted steel in the steel ladle, measuring the temperature of the melted steel after blowing argon for 3 min to 8 min, performing oxygen determination and sampling, feeding the aluminum wire into the melted steel according to the oxygen content of the melted steel for final deoxidation and aluminizing of the melted steel, and keep blowing argon for 2 min to 10 min.

5. The method for manufacturing steel NM450 according to claim 1, wherein the slagging materials in the step (3) comprise lime, synthetic slag, pre-dissolved slag or a slag regulator.

6. The method for manufacturing steel NM450 according to claim 1, wherein in the step (12), a shot blasting speed is no more than 4 m/min, and a roughness of the steel plate after shot blasting ranges from 25 μm to 55 μm.

* * * * *